US008899207B2

(12) United States Patent
Megel et al.

(10) Patent No.: US 8,899,207 B2
(45) Date of Patent: Dec. 2, 2014

(54) CYLINDER HEAD FOR AN ENGINE

(75) Inventors: Marc C. Megel, LaVernia, TX (US); Mark A. Tussing, San Antonio, TX (US); Barry E. Westmoreland, Adkins, TX (US); Douglas A. McKee, Helotes, TX (US); Riccardo Meldolesi, Shoreham-by-Sed (GB); Gareth Roberts, Newhaven (GB)

(73) Assignee: Southwest Research Institute, San Antonio, TX (US)

( * ) Notice: Subject to any disclaimer, the term of this patent is extended or adjusted under 35 U.S.C. 154(b) by 1180 days.

(21) Appl. No.: 12/578,910

(22) Filed: Oct. 14, 2009

(65) Prior Publication Data

US 2011/0083624 A1 Apr. 14, 2011

(51) Int. Cl.
*F02F 1/42* (2006.01)
*F02F 1/40* (2006.01)
*F02F 1/24* (2006.01)

(52) U.S. Cl.
CPC . *F02F 1/40* (2013.01); *F02F 1/242* (2013.01); *F02F 1/4214* (2013.01)
USPC ..... 123/193.5

(58) Field of Classification Search
CPC ..... F01P 3/02; F01P 3/14; F01P 3/16; F02F 1/24; F02F 1/242; F02F 1/26; F02F 1/36; F02F 1/38; F02F 1/40
USPC ..... 123/193.5, 41.72, 41.77, 41.82 R, 123/41.82 A, 41.85, 41.32, 470
See application file for complete search history.

(56) References Cited

U.S. PATENT DOCUMENTS

| | | | | |
|---|---|---|---|---|
| 1,526,744 | A * | 2/1925 | Eberle | 123/41.79 |
| 2,739,579 | A * | 3/1956 | Ware et al. | 123/41.31 |
| 2,777,431 | A | 1/1957 | Meurer | |
| 3,420,215 | A * | 1/1969 | Seifert | 123/268 |
| 3,824,971 | A * | 7/1974 | Skatsche et al. | 123/302 |
| 4,083,333 | A * | 4/1978 | Rudert et al. | 123/41.82 R |
| 4,106,444 | A | 8/1978 | Deutschmann et al. | |
| 4,112,906 | A | 9/1978 | Spencer | |
| 4,304,199 | A * | 12/1981 | Formia et al. | 123/254 |
| 4,328,772 | A | 5/1982 | Heydrich et al. | |
| 4,344,390 | A | 8/1982 | Heydrich et al. | |
| 4,436,066 | A * | 3/1984 | Formia et al. | 123/193.5 |
| 4,889,079 | A * | 12/1989 | Takeda et al. | 123/41.82 R |
| 4,957,085 | A | 9/1990 | Sverdlin | |

(Continued)

OTHER PUBLICATIONS

U.S. Office Action, mail date Jul. 3, 2012 issued in related U.S. Appl. No. 12/578,936 (9 pgs).

(Continued)

*Primary Examiner* — Hung Q Nugyen
(74) *Attorney, Agent, or Firm* — Grossman, Tucker et al

(57) ABSTRACT

A cylinder head for an engine is provided comprising a monolithic structure forming an upper deck, a fire deck, at least one coolant jacket and a cavity to accommodate a fuel injector or an ignitor therein, the cavity defined by a wall connecting the fire deck with the upper deck. The wall connecting the fire deck with the upper deck, as well as other features of the cylinder head, are preferably arranged to support the fire deck against a deflection thereof by transmitting a mechanical load introduced on a flame face of the fire deck to the upper deck. A method of increasing the stiffness of the cylinder head is also provided.

23 Claims, 9 Drawing Sheets

(56) References Cited

U.S. PATENT DOCUMENTS

| | | | | |
|---|---|---|---|---|
| 5,295,462 | A | 3/1994 | Barnes et al. | |
| 5,345,913 | A | 9/1994 | Belshaw et al. | |
| RE35,079 | E | 11/1995 | Sverdlin | |
| 5,868,106 | A * | 2/1999 | Poropatic et al. | 123/41.82 R |
| 5,873,331 | A * | 2/1999 | Jutz | 123/41.82 R |
| 6,112,722 | A | 9/2000 | Barnhart et al. | |
| 6,155,236 | A | 12/2000 | Jehle et al. | |
| 6,295,969 | B1 | 10/2001 | Kato et al. | |
| 6,681,727 | B2 * | 1/2004 | Krenn | 123/41.82 R |
| 6,769,383 | B2 | 8/2004 | Doers et al. | |
| 6,786,184 | B2 * | 9/2004 | Oh | 123/41.82 R |
| 6,817,322 | B2 * | 11/2004 | Hardin | 123/41.82 R |
| 6,899,063 | B2 | 5/2005 | Obermayer et al. | |
| RE41,335 | E | 5/2010 | Doers | |
| 7,827,976 | B2 | 11/2010 | Na | |
| 8,001,935 | B2 * | 8/2011 | Haubner et al. | 123/41.82 R |
| 8,544,450 | B2 | 10/2013 | Megel et al. | |
| 2002/0157629 | A1 | 10/2002 | Inagaki et al. | |
| 2003/0213453 | A1 * | 11/2003 | Matsuda | 123/169 PA |
| 2004/0040521 | A1 * | 3/2004 | Hardin | 123/41.82 R |
| 2005/0229875 | A1 * | 10/2005 | Maassen et al. | 123/41.82 R |
| 2006/0196453 | A1 * | 9/2006 | Yamada et al. | 123/41.32 |
| 2009/0114173 | A1 * | 5/2009 | Haubner et al. | 123/41.72 |
| 2011/0083622 | A1 | 4/2011 | Megel et al. | |

OTHER PUBLICATIONS

U.S. Office Action, mail date Dec. 19, 2012 issued in related U.S. Appl. No. 12/578,936 (10 pgs).

* cited by examiner

CYLINDER HEAD FOR AN ENGINE

FIELD OF THE INVENTION

The present invention relates to internal combustion engines, and more particularly to the cylinder heads and components thereof.

BACKGROUND

Gaseous emissions from internal combustion engines, notably oxides of nitrogen, which may be referred to as "NOx", may be reduced by reducing engine combustion temperature. For diesel engines, a method which may be utilized for reducing combustion temperature is to add exhaust gas recirculation ("EGR") to the charge air. As the EGR displaces air from the cylinder, the air and added EGR must be delivered to the engine at a higher pressure to maintain engine power, which may be achieved by pressure charging the engine. One consequence of the pressure charging is that the engine cylinder pressures increase to a point where the integrity of conventional cylinder head structure may be inadequate, resulting in cylinder head fatigue, deflection and other deformation, as well as cylinder head gas and coolant leaks. In light of the above, what is needed is an engine with a cylinder head which overcomes the aforementioned deficiencies in the art.

SUMMARY

The inventions disclosed herein provide means of increasing the cylinder pressure capability and mechanical integrity of an engine cylinder head. This may be achieved by an optimization of the cylinder head design for structural stiffness, as well as accommodation of thermal and mechanical loads placed on the cylinder head, through a unique combination of design features. Such design features include various elements of the cylinder head such as the ports (valve/valve seats), decks, coolant jackets, mounting bolt pattern, sleeves for fuel injectors or ignitors, side walls and interior walls, as well as any other elements of the cylinder head disclosed herein.

According to one aspect of the invention, a cylinder head for an engine may be provided comprising a valve seat arrangement for a cylinder of the engine, with the valve seat arrangement comprising at least two inlet valve seats on an inlet valve seat axis at an angle in a range of 30 to 60 degrees to a major axis of the engine, and at least two exhaust valve seats on an exhaust valve seat axis at an angle in a range of 30 to 60 degrees to the major axis of the engine; an upper deck, an intermediate deck and a fire deck; an upper coolant jacket between the upper deck and the intermediate deck; a lower coolant jacket between the intermediate deck and the fire deck; and a cavity to accommodate a fuel injector or an ignitor therein, with the cavity defined by a monolithic wall connecting the fire deck with the upper deck. From this combination of features, as well as other features herein, increased stiffness of the cylinder head may be realized, which may effectively inhibit undesirable stressing, deflecting and otherwise deforming of the cylinder head fire deck or other portions thereof.

In preferred embodiments, the upper deck thickness and fire deck thickness may be greater than the intermediate deck thickness. For example, the upper deck thickness and fire deck thickness may be in a range of 150% to 300% of the intermediate deck thickness.

In preferred embodiments, the upper coolant jacket may comprise a half coolant jacket, and the half coolant jacket may be located on an exhaust side of the cylinder head.

In preferred embodiments, the lower coolant jacket may comprise a full coolant jacket, and more preferably a cross-flow coolant jacket which may provide a coolant path arranged for a coolant to flow through the cylinder head perpendicular to a major axis of the engine.

In preferred embodiments, at least one of the upper coolant jacket and the lower coolant jacket may be in fluid communication with an external coolant manifold.

In preferred embodiments, the cavity to accommodate the fuel injector or the ignitor may be in fluid communication with at least one of the upper coolant jacket and the lower coolant jacket, and the monolithic wall connecting the fire deck with the upper deck may be cylindrical. The monolithic wall connecting the fire deck with the upper deck may be arranged to support the fire deck against a deflection thereof by transmitting a mechanical load introduced on a flame face of the fire deck to the upper deck.

According to another aspect of the invention, a cylinder head for an engine may be provided comprising a monolithic structure forming an upper deck, an intermediate deck, a fire deck, a lower coolant jacket located between the fire deck and the intermediate deck, an upper coolant jacket located between the intermediate deck and the upper deck and a cavity to accommodate a fuel injector or an ignitor therein, with the cavity defined by a wall connecting the fire deck with the upper deck.

In preferred embodiments, the upper deck thickness and fire deck thickness may be greater than the intermediate deck thickness. For example, the upper deck thickness and fire deck thickness may be in a range of 150% to 300% of the intermediate deck thickness.

In preferred embodiments, the lower coolant jacket located between the fire deck and the intermediate deck may comprise a full coolant jacket, and more preferably a cross-flow coolant jacket which may provide a coolant path arranged for a coolant to flow through the cylinder head perpendicular to a major axis of the engine.

In preferred embodiments, the upper coolant jacket located between the intermediate deck and the upper deck may comprise a half coolant jacket, and the half coolant jacket may be located on an exhaust side of the cylinder head.

In preferred embodiments, at least one of the lower coolant jacket and the upper coolant jacket may be in fluid communication with an external coolant manifold.

In preferred embodiments, the cavity to accommodate the fuel injector or the ignitor may be in fluid communication with at least one of the lower coolant jacket and the upper coolant jacket, and the wall connecting the fire deck with the upper deck may be cylindrical. The wall connecting the fire deck with the upper deck may be arranged to support the fire deck against a deflection thereof by transmitting a mechanical load introduced on a flame face of the fire deck to the upper deck.

According to another aspect of the invention, a method of increasing the stiffness of a cylinder head for an engine is provided, with the method comprising: providing a valve seat arrangement for a cylinder of the engine, the valve seat arrangement comprising at least two inlet valve seats on an inlet valve seat axis at an angle of 30 to 60 degrees to a major axis of the engine, and at least two exhaust valve seats on an exhaust valve seat axis at an angle of 30 to 60 degrees to the major axis of the engine; providing an upper deck, an intermediate deck and a fire deck; providing an upper coolant jacket between the upper deck and the intermediate deck;

providing a lower coolant jacket between the intermediate deck and the fire deck; and providing a cavity to accommodate a fuel injector or an ignitor therein, the cavity defined by a monolithic wall connecting the fire deck with the upper deck.

According to another aspect of the invention, a cylinder head sleeve for a cylinder head of an engine may be provided comprising a sleeve first part and a sleeve second part, wherein the sleeve first part and the sleeve second part form a cavity to contain a fuel injector or an ignitor, and wherein the sleeve first part and the sleeve second part form a joint for the sleeve first part and the sleeve second part to move relative to each other. As a result, an expansion of a cylinder head assembly under thermal loading may be better accommodated, which may effectively inhibit undesirable stressing, deflecting and otherwise deforming of the cylinder head fire deck or other portions thereof. Furthermore undesirable stress, deflection and other deformation as a result of mechanical loading on the cylinder head assembly may also be inhibited.

In preferred embodiments, the sleeve first part and the sleeve second part may have overlapping cylindrical portions, and the sleeve second part may slide within the sleeve first part. A coolant seal may be located between the overlapping portions.

In preferred embodiments, the joint may provide a gap between a contact surface of the sleeve first part and a contact surface of the sleeve second part. The gap may be adjusted to change a distance between the contact surfaces of the sleeve first part and the sleeve second part. The contact surface of the sleeve first part and the contact surface of the sleeve second part may be preferably horizontal and parallel surfaces.

According to another aspect of the invention, a cylinder head assembly for an engine may be provided comprising a sleeve having a first part and a sleeve second part, wherein the sleeve first part and the sleeve second part form a cavity to contain a fuel injector or an ignitor, and wherein the sleeve first part and the sleeve second part form a joint for the sleeve first part and the sleeve second part to move relative to each other; and a cylinder head.

In preferred embodiments, the cylinder head may comprise an upper deck, and the sleeve first part may be connected with the upper deck, such as by a threaded engagement with the upper deck. The cylinder head may also comprise a lower deck, and the sleeve second part may be connected with the lower deck, such as by an interference fit with the lower deck. A coolant seal may be provided between the sleeve first part and the upper deck, another coolant seal may be provided between the sleeve second part and the lower deck, and another coolant seal may be provided between the sleeve first part and the sleeve second part.

In preferred embodiments, the sleeve may be removable from a cavity in the cylinder head. The cylinder head may comprise an upper deck, an intermediate deck and a lower deck, wherein a lower coolant jacket may be located between the fire deck and the intermediate deck, and an upper coolant jacket may be located between the intermediate deck and the upper deck. The lower coolant jacket located between the fire deck and the intermediate deck may comprise a full coolant jacket and more preferably a cross-flow coolant jacket which may provide a coolant path arranged for a coolant to flow through the cylinder head perpendicular to a major axis of the engine.

In preferred embodiments, the upper coolant jacket located between the intermediate deck and the upper deck may comprise a half coolant jacket, and the half coolant jacket may be located on an exhaust side of the cylinder head.

In preferred embodiments, at least one of the lower coolant jacket and the upper coolant jacket may be in fluid communication with an external coolant manifold.

In preferred embodiments, the cylinder head may comprise a cavity to accommodate the sleeve therein, with the cavity defined by a monolithic wall connecting the fire deck to the upper deck. The monolithic wall may be cylindrical.

In preferred embodiments, at least one of the lower coolant jacket and the upper coolant jacket may be in fluid communication with the cavity to accommodate the sleeve.

According to another aspect of the invention, a method of providing a cylinder head assembly may be provided comprising providing a sleeve for a fuel injector or an ignitor, the sleeve comprising a sleeve first part and a sleeve second part, wherein the sleeve first part and the sleeve second part form a cavity to contain the fuel injector or the ignitor, and wherein the sleeve first part and the sleeve second part form a joint for the sleeve first part and the sleeve second part to move relative to each other; placing a fuel injector or ignitor in the sleeve; providing a cylinder head comprising an upper deck, a fire deck and at least one coolant jacket located between the upper deck and the fire deck; connecting the sleeve first part to the upper deck of the cylinder head; and connecting the sleeve second part to the fire deck of the cylinder head.

In preferred embodiments, the steps of connecting the sleeve first part to the upper deck of the cylinder head and connecting the sleeve second part to the fire deck of the cylinder head may position the sleeve first part relative to the sleeve second part for the joint formed by the sleeve first part and the sleeve second part to be contracted. Consequently, upon use thereof, heating of the cylinder head assembly may expand the cylinder head assembly resulting in contracting of the joint formed by the sleeve first part and the sleeve second part. Contraction of the joint formed by the sleeve first part and the sleeve second part may also result from deflection of the fire deck.

Contracting the joint formed by the sleeve first part and the sleeve second part may further comprise contracting the joint until the joint is in a fully contracted state. In this manner, supporting a mechanical load introduced on a flame face of the fire deck through the joint to the upper deck of the cylinder head assembly may be better accommodated.

According to another aspect of the invention, a removable sleeve for fuel injector or ignitor is used in a cylinder head for at least one cylinder comprising two side walls; two end walls; three decks of preferred thickness; port walls of preferred thickness; a diamond shaped orientation of valve seats; a one haft upper coolant jacket; a lower coolant jacket and an external coolant manifold. In alternative embodiments, load bearing removable sleeve may be replaced or used in conjunction with load bearing cylindrical housing defining cavity for fuel injector or ignitor. From this combination of features increased stiffness of a cylinder head has been shown through analysis, which may effectively inhibit undesirable stressing, deflecting and otherwise deforming of the cylinder head fire deck or other portions thereof, and a cylinder head geometry may be provided which is optimized for structural stiffness and peak operating cylinder pressure capability.

BRIEF DESCRIPTION OF THE DRAWINGS

The above-mentioned and other features of this disclosure, and the manner of attaining them, will become more apparent and better understood by reference to the following description of embodiments described herein taken in conjunction with the accompanying drawings, wherein.

DETAILED DESCRIPTION

Figure 1:
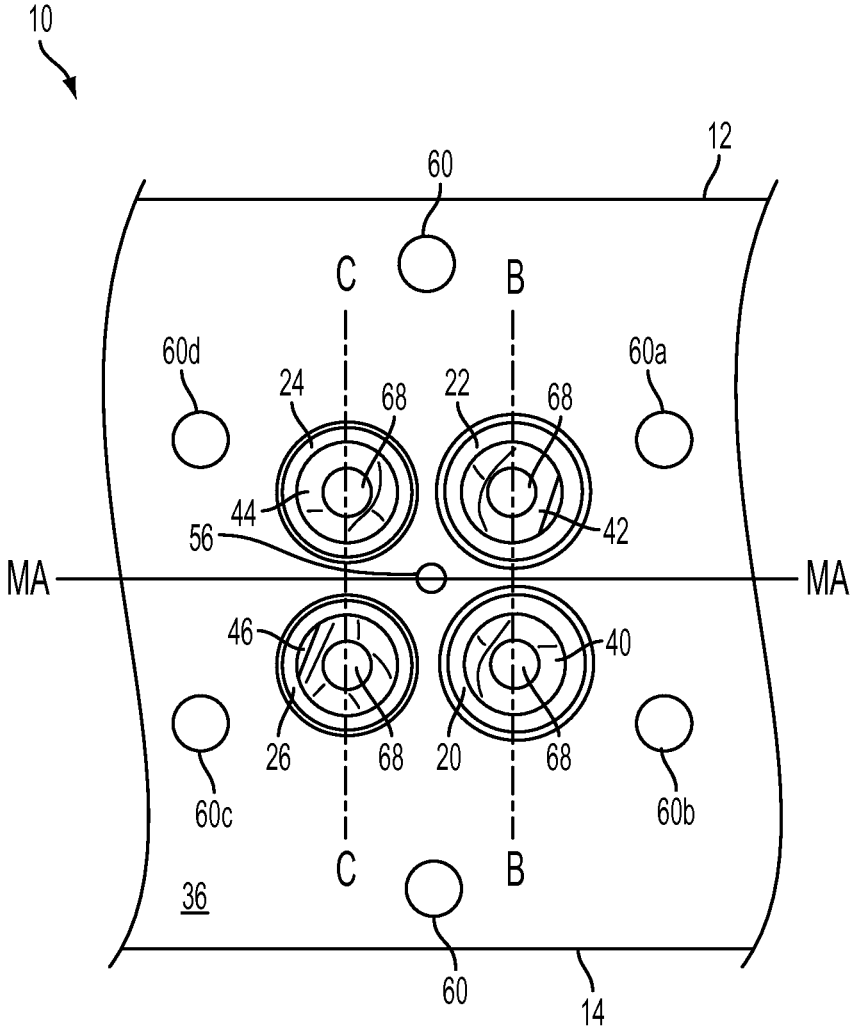
FIG. 1 is a plan view of one cylinder portion of a diesel engine cylinder head with a 90 degree valve seat orientation.

It may be appreciated that the present disclosure is not limited in its application to the details of construction and the arrangement of components set forth in the following description or illustrated in the drawings. The embodiments herein may be capable of other embodiments and of being practiced or of being carried out in various ways. Also, it may be appreciated that the phraseology and terminology used herein is for the purpose of description and should not be regarded as limiting.

In the context of this description, a cylinder head for an internal combustion engine is presented wherein the engine has a major or longitudinal axis taken through the length of the crankshaft, from front to rear ends of the engine when the engine is arranged as such in a vehicle. As presented herein, the major axis of the engine is horizontal and, for multi-cylinder applications, the cylinders may be laid out in an inline configuration along the major axis, with the cylinder head to cylinder block joint lying in a horizontal plane. "Vertical" orientation is at right angle to this horizontal plane. However, the invention applies equally well to any other engine orientation or configuration, and the inline configuration referenced herein is selected simply to establish a geometric orientation frame of reference. Having discussed the orientation of the engine, certain engine terminology will now be presented.

An "injector sleeve" or an "ignitor sleeve" is a containment in the cylinder head for the injector or ignitor, respectively, particularly to exclude oil, water and other fluid contaminates from the injector or ignitor. Use of the term "sleeve" herein without a designation should be understood to include either an injector sleeve or ignitor sleeve.

A "coolant jacket" of a cylinder head is that part of the cylinder head which contains a fluid coolant, such as a liquid mixture of water and anti-freeze, and distributes the coolant to the various parts of the cylinder head. The coolant jacket receives coolant from a coolant source at a lower temperature, such as a radiator, heats the coolant and transfers the coolant at a higher temperature to a coolant manifold which may be integral with the cylinder head or may be a separate part (external).

A "cylinder head deck" is a substantially horizontal plate element of a cylinder head structure. A cylinder head may have at least three decks, namely a top deck, which is uppermost and may be referred to as the upper deck; a fire deck, which is the bottom deck and overlies the cylinder block; and an intermediate deck which is between the fire and top decks. The coolant jacket is contained between these decks.

"Manifolds" conduct air into the inlet ports in the cylinder head, and allow exhaust gases to exit via the exhaust ports. The inlet manifold is generally connected to one vertical side face of the cylinder head along the major axis of the engine and the exhaust manifold is generally connected to the other (opposing) vertical side face of the cylinder head along the major axis of the engine; these faces are frequently known as the manifold faces.

The "end walls" of the cylinder head are the substantially vertical end faces at the longitudinal ends, generally front and rear, of the cylinder head which are perpendicular to the major axis and which connect with the vertical side faces of the cylinder head.

"Bolt bosses" are substantially vertical columns passing through the coolant jacket, to take the compressive load of the bolts or other fasteners which secure the cylinder head to the cylinder block, with a vertical central bore, such as a cylindrical drilling, to accommodate the bolts or other fasteners and fixing means.

"Thermal loading" of the cylinder head is due to the heat flow into the cylinder head structure. The heat flow increases the metal temperature of the cylinder head, giving rise to thermal stressing, due to material expansion effects, and the material properties of the cylinder head usually deteriorate as the metal temperatures increase, augmenting the displacements from thermal and mechanical loading.

"Mechanical loading" is generally considered loading of the cylinder head due to purely mechanical loads, such as the cylinder pressures, or bolt and other fastener tightening torques.

"Cross (coolant) flow" describes the manner in which coolant is arranged to flow from one longitudinal side of the cylinder head to the other longitudinal side, which is perpendicular to the major or longitudinal axis. For example, the coolant might flow from an entrance opening on the inlet manifold side of the cylinder head to an exit opening on the exhaust manifold side of the cylinder head where it is expelled therefrom, via the coolant jacket.

"Longitudinal (coolant) flow" describes the manner in which coolant is arranged to flow from one end of the cylinder head to the other end, which is parallel with the major or longitudinal axis. For example, the coolant might flow from the flywheel end of the cylinder head to the front end of the cylinder head via the lower coolant jacket.

Turning to the drawings, FIG. 1 shows a valve seat arrangement of one cylinder of a cylinder head 10 having four valves per cylinder in which the inlet and exhaust valves (not shown) and the respective valve seats are arranged parallel and at a 90° (degree) orientation relative to one another. Inlet valve seats 20, 22 may be arranged (shown centered) on a first axis B-B, which may be referred to as an inlet valve seat axis, which may be substantially orthogonal (shown at 90 degrees) to the major longitudinal side faces 12, 14, or the engine's major axis MA. In a similar fashion, exhaust valve seats 24, 26 may be arranged (shown centered) on a second axis C-C, which may be referred to as an exhaust valve seat axis, which also may be substantially orthogonal (shown at 90 degrees) to the major longitudinal side faces 12, 14, or the engine's major axis MA. Furthermore, the axis B-B between the inlet valve seats 20, 22 is substantially parallel (shown as parallel) to the axis C-C between the exhaust valve seats 24, 26.

Figure 2:
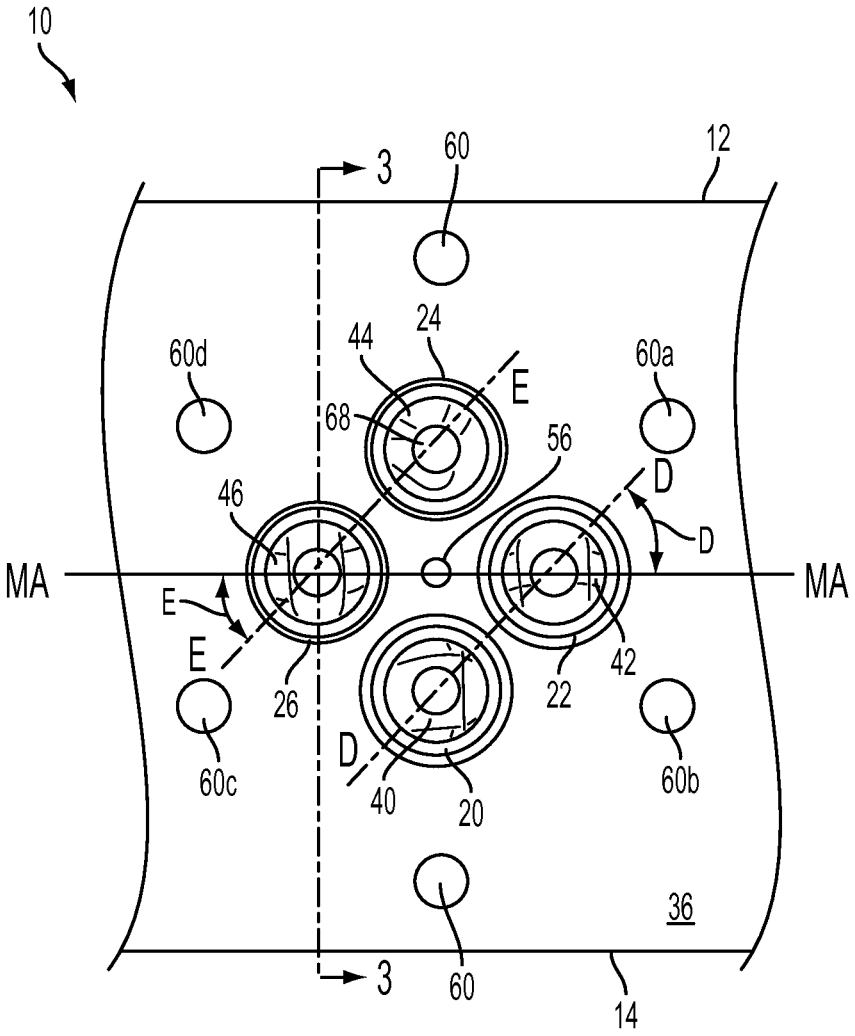
FIG. 2 is a plan view of one cylinder portion of a diesel engine cylinder head with a diamond shaped valve seat orientation.

FIG. 2 shows a valve seat arrangement of one cylinder of a cylinder head 10 having four valves per cylinder in which the inlet and exhaust valves (not shown) and the respective valve seats have a diamond shaped orientation relative to the major axis MA of the engine. As shown, inlet valve seats 20, 22 may be are arranged (shown centered) on a first axis D-D, which may be referred to as an inlet valve seat axis, which may be at an angle D (inlet valve seat angle) in a range between and including 30 to 60 degrees to the major longitudinal side faces 12, 14, or the engine's major axis MA, as well as at any increments therebetween. In a similar fashion, exhaust valve seats 24, 26 may be arranged (shown centered) on a second axis E-E, which may be referred to as an exhaust valve seat axis, which also may be at an angle E (exhaust valve seat angle) in the range between and including 30 to 60 degrees to the major longitudinal side faces 12, 14, or the engine's major axis MA, as well as at any increments therebetween. Also as shown, the axis D-D between the inlet valve seats 20, 22 is substantially parallel (shown parallel) to the axis E-E between the exhaust valve seats 24, 26. Side faces 12, 14 of cylinder head 10 provide mating manifold faces which align and otherwise interact with the faces of an inlet manifold and exhaust manifold.

With respect to the stiffness of cylinder head 10, the valve seat arrangement of FIG. 2 offers greater stiffness to the cylinder head than the valve seat arrangement of FIG. 1. Without being bound to a particular theory, the arrangement of FIG. 2 offers greater stiffness to the cylinder head than the valve seat arrangement of FIG. 1 due to its more angularly uniform distribution of vertical wall elements about the center of the cylinder axis. This uniform distribution better supports the central region of the cylinder section than the 90° arrangement, which biases the vertical wall elements on either side of the cylinder head's longitudinal axis without supporting the inherently weak central region.

As shown in FIGS. 1 and 2, inlet valve seats 20, 22 are each defined by a circular opening in flame face 36 of fire deck 38 for inlet port passages 40, 42, respectively. Similarly, exhaust valve seats 24, 26 are also each defined by a circular opening in flame face 36 of fire deck 38 for exhaust port passages 44, 46, respectively.

Continuing with FIGS. 1 and 2, the cylinder head 10 further includes a cylindrical thru-hole 56 which is shown located close to the center of each cylinder portion, shown located between the valve seats 20, 22, 24 and 26. Hole 56 extends to a cavity (shown at 120 in FIG. 8) and receives a nozzle of a fuel injector or an electrode of an ignitor (shown at 134 in FIG. 8). Cylinder head 10 also includes six surrounding cylindrical thru-holes 60 arranged in a hexagon orientation which surround the valve arrangement for each cylinder. Holes 60 are to receive six fixing bolts (not shown) therein which extend through six corresponding bolt bosses 62 (exemplary bosses shown FIG. 3) and connect to a the engine's cylinder block (not shown) to thereby secure the cylinder head 10 to the cylinder block. Bolts for holes 60*a*, 60*b* are shared with a first adjacent cylinder, whilst bolts for holes 60*c*, 60*d* are shared with a second adjacent cylinder.

Figure 3:
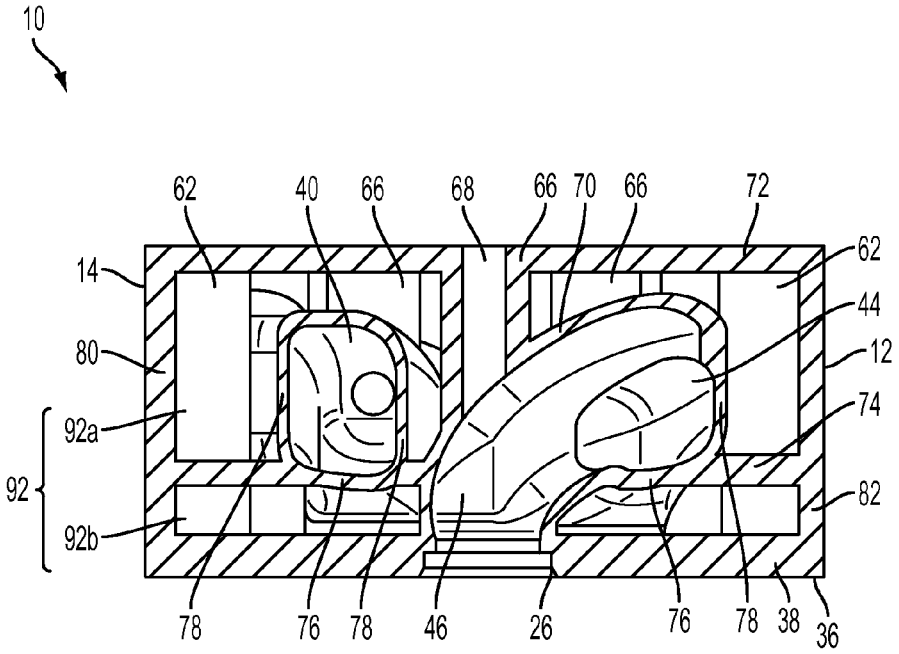
FIG. 3 is a cross sectional view of the cylinder head portion of FIG. 2 taken along line 3-3 of FIG. 2.

Now with reference to FIG. 3, exhaust valve seat 26 is shown in the foreground. Within cylinder head 10, exhaust port passages 40, 44 and 46 are shown, with ports 44 and 46 shown to merge within cylinder head 10 prior to extending to a shared opening on side face 12. However, it is not necessary for the port passages to merge within cylinder head 10.

As shown in FIG. 3, each portion of cylinder head 10 for a particular cylinder includes a valve guide boss 66 for each valve, with a cylindrical thru-hole 68. Each valve guide boss 66 is used to guide a valve stem to be contained within hole 68. As can be seen from FIG. 3, at one end, valve guide bosses 66 intersect and connect an upper wall or ceiling portion 70 defining each of port passages 40, 42, 44 and 46, while at the opposite end, bosses 66 connect to the top or upper deck 72 of cylinder head 10.

Thus far, upper deck 72 and fire deck 38 are therefore connected by the structure of the six bolt bosses 62; four valve guide bosses 66; inlet port passages 40, 42; and exhaust port passages 44, 46. Furthermore, upper deck 72 and fire deck 38 are connected by a cylindrical housing 58 defining cavity 120 for fuel injector or ignitor 134 (shown in FIGS. 8 and 9). All are contained within the confines of manifold side walls 80, 82 having side faces 12, 14 respectively; and end walls 84, 86 having end faces 16, 18, respectively (wall 86 and end face 18 shown in FIG. 5, end wall 84 and end face 16 similar).

Intermediate, or middle, deck 74, which connects with the two manifold side walls 80, 82, may be arranged to connect with the lower wall or floor portion 76 defining port passages 40, 42, 44, 46, and may partly form the floors of the passages to provide a transverse connection between the vertical wall portions 78 and the four outer vertical walls 80, 82, 84, 86 of the cylinder head 10. Upper deck 72 and fire deck 38 are preferably thicker than intermediate deck 74. More particularly, the upper deck 72 and fire deck 38 are usually substantially thicker than the intermediate deck 74, and can be, for example, from 150-300% as thick as the intermediate deck 74. Also, preferably the wall portions 70, 78 of port passages 40, 42, 44 and 46 have a thickness of 25-50% that of the fire deck thickness.

The cavity within the four side walls 80, 82, 84, 86 of cylinder head 10 between the upper deck 72 and fire deck 38 that is not occupied by the inlet port passages 40, 42; exhaust port passages 44, 46; bolt bosses 62; valve guide bosses 66; and housing 58 may be referred to as the coolant jacket 92, and in the case of the cylinder head 10 of FIG. 3 comprises an upper coolant jacket 92*a* and a lower coolant jacket 92*b* separated by the intermediate deck 74. There may be localized openings within the intermediate deck 74 and/or within housing 58 to cavity 120 (as described in greater detail below) which provide fluid communication between the upper coolant jacket 92*a* and lower coolant jacket 92*b*.

The coolant jackets 92*a* and 92*b* shown in FIG. 3 may be referred to "full" upper and "full" lower coolant jackets in that the coolant jackets 92*a* and 92*b* have a width which is substantially equal to a full width of the cylinder head and occupy the cylinder head 10 internal cavity defined by walls 80, 82, 84 and 86, other than that occupied by the inlet port passages 40, 42; exhaust port passages 44, 46; bolt bosses 62; valve guide bosses 66; or housing 58.

Figure 4:
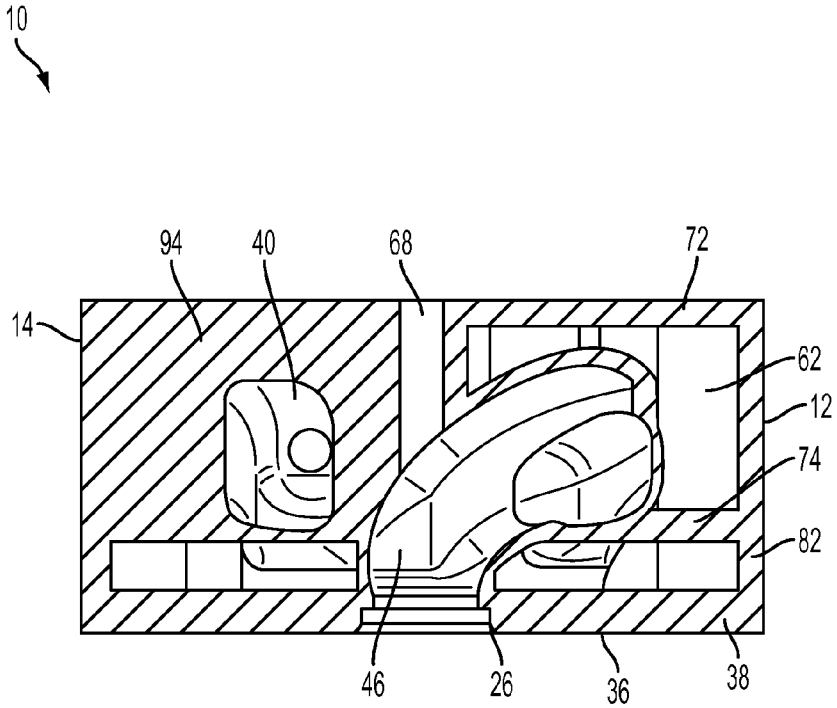
FIG. 4 is a cylinder head cross section with a one half upper coolant jacket.

FIG. 4 shows essentially the same cylinder head arrangement as FIG. 3, but the volume 94 of the upper coolant jacket 92*a* above the inlet port passages 40, 42 has been eliminated and replaced with the metal structure of the cylinder head, with this arrangement being called a "half" upper coolant jacket.

Figure 5:
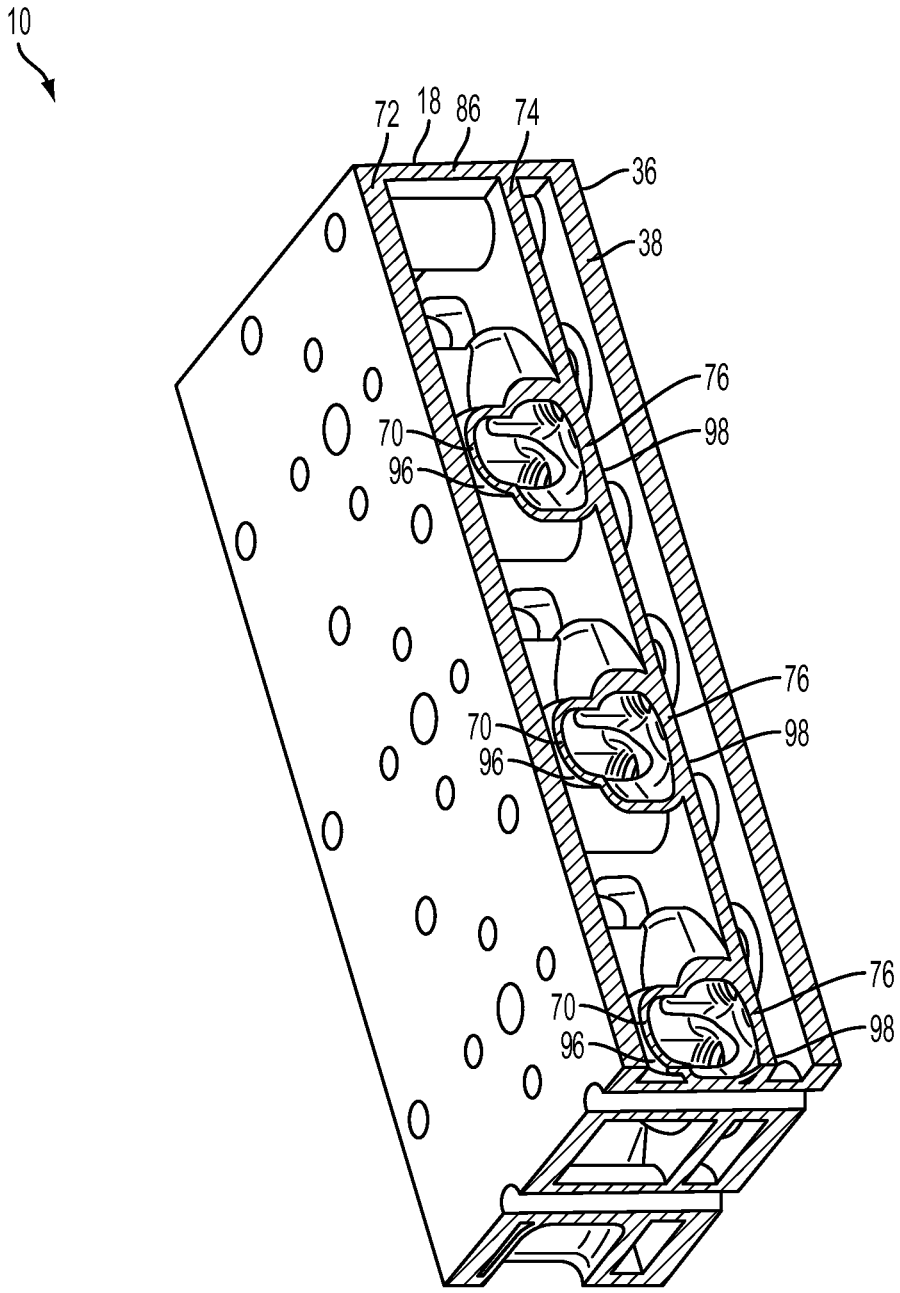
FIG. 5 is a cylinder head longitudinal cross section near the inlet manifold face for a cylinder head.

Turning to FIG. 5, a side of a cylinder head 10 is shown with a manifold side wall and end wall removed, for ease of explanation, prior to the incorporation of certain features which will now be discussed. As shown, the water jacket surfaces 96 of the upper wall or ceiling portion 70 of the port passages are not fused or connected with upper deck 72. Also, the water jacket surfaces 98 of the lower wall or floor portion 76 of the port passages are not fused or connected with the fire deck 38.

Figure 6:
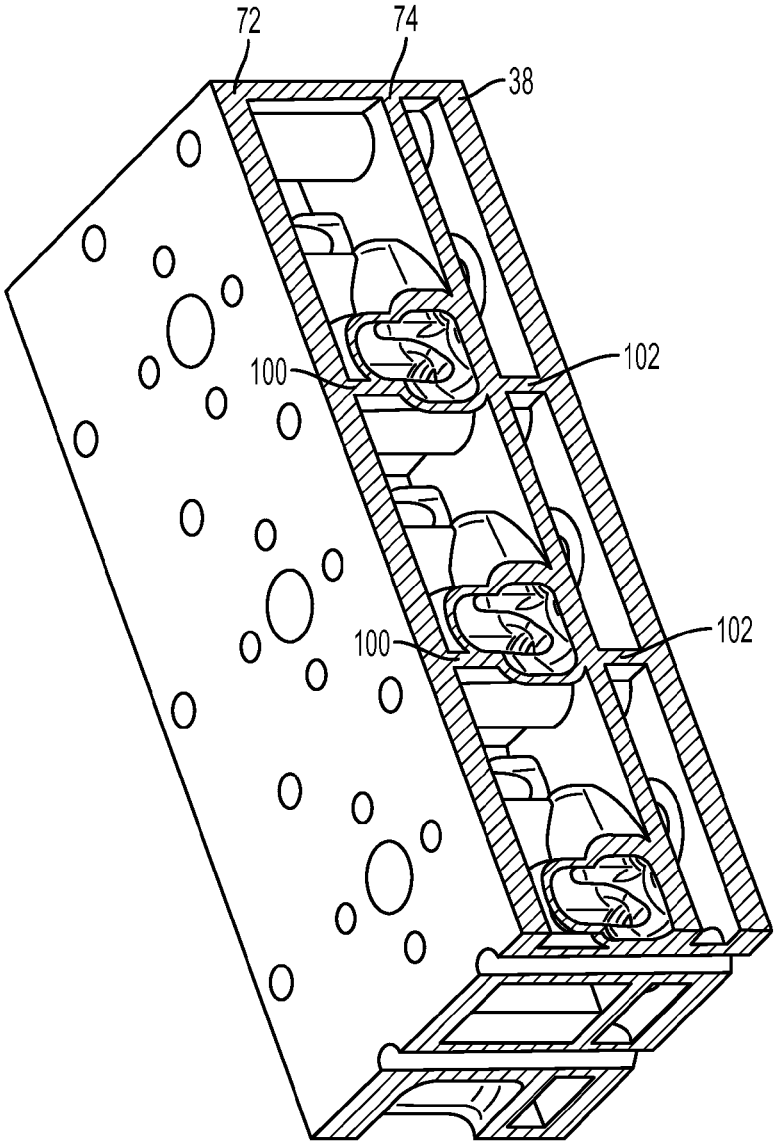
FIG. 6 is a cylinder head longitudinal cross section near the inlet manifold face for an improved cylinder head.

Now, as shown by FIG. 6, the improvement of vertical walls 100 which may be cast to connect water jacket surfaces 96 of the upper wall or ceiling portion 70 of the port passages to upper deck 72. FIG. 6 also includes the improvement of vertical walls 102 which may be cast to connect water jacket surfaces 98 of the lower wall or floor portion 76 of the port passages to fire deck 38, as well as intermediate deck 74. Vertical wall 100, 102 may be used to increase the stiffness of the cylinder head 10. However, if these walls 100, 102 fully divide the coolant jackets 92*a*, 92*b* into a plurality of individual chambers (e.g. one chamber for each cylinder), a cross-flow coolant path will be employed rather than a longitudinal coolant path as discussed in greater detail below.

Figure 7:
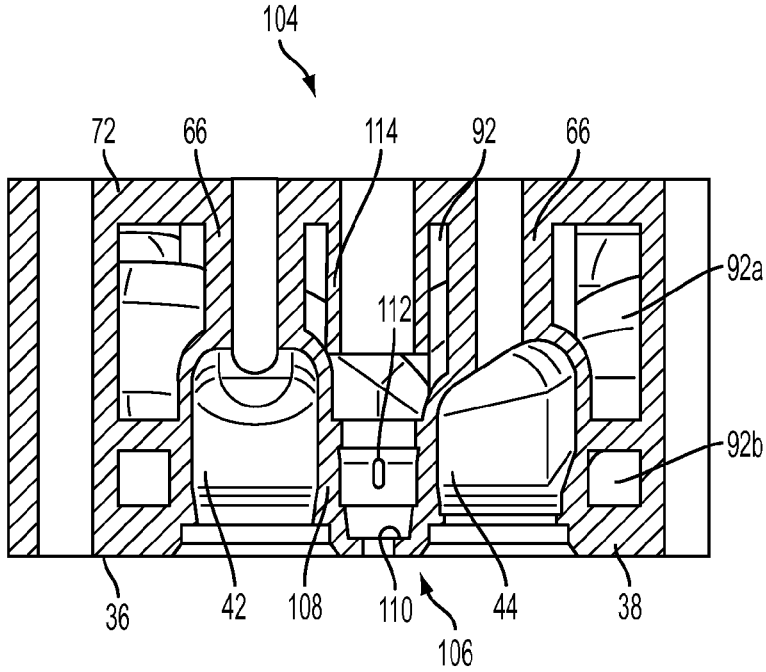
FIG. 7 is a cylinder head transverse cross section showing valve seats and a cast-in bore to accommodate a removable sleeve.

With reference to FIG. 7, a cast arrangement 104 and 106 is shown which may be used to accommodate a removable single piece sleeve which seals the fuel injector from the coolant within the coolant jacket (not shown). Arrangement 104, 106 is located in the center of the cylinder head 10 adjacent to inlet port passages 40, 42 (only 42 shown) and exhaust port passages 44, 46 (only 44 shown). More particularly, arrangement 106 shares a wall 108 with the port passages 42 and 44. However, as shown, wall 108 does not connect with cylindrical wall 114 of cast arrangement 104, but rather valve guide boss 66, which connect to upper deck 72.

The removable single piece sleeve (not shown) is usually a swaged fit into the fire deck 38 and is sealed by a flexible polymer (elastomer) seal, such as an O ring, with the upper deck 72, the removable sleeve being maintained in its position by the clamping force on the injector onto the upper face 110 of the fire deck 38. Coolant can be arranged to enter the volume between wall 108 and the sleeve via openings 112, as well as exit into the upper coolant jacket 92*a* via other openings which are not shown.

Figure 8:
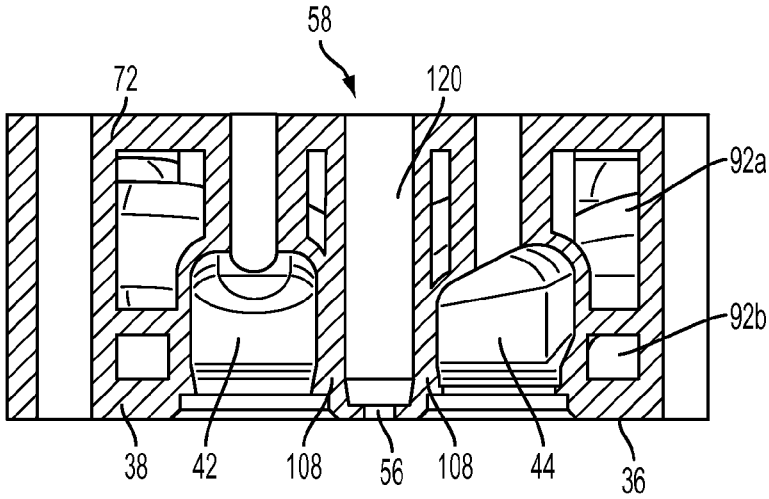
FIG. 8 is a cylinder head transverse cross section showing valve seats and the improvement of a cast-in housing not necessarily requiring a removable sleeve.

FIG. 8 shows the same section as FIG. 7, but with an improvement of a cast-in housing 58, shown as a cylindrical housing defining a cylindrical cavity 120 to accommodate a fuel injector or ignitor, which directly connects with the fire deck 38 and upper deck 72, as well as sharing wall 108 and being fused with the ports passages 40, 42, 44, 46 (only 42 and 44 shown).

As compared to the design of FIG. 7, the improvement of the cast-in housing 58, being at the point of maximum deflection of the cylinder head 10 and being of similar height to the cylinder head 10, does much to increase the stiffness of the cylinder head 10 and therefore reduces deflections of the flame face 36 resulting from cylinder pressure loads. Integral housing 58, therefore, may properly be considered to be a load bearing member.

Additionally, the rigid nature of the cast-in housing 58 resists the natural expansion of the fire deck 38 under thermal loads which can impose thermal strain. As shown, cavity 120 is completely isolated from coolant from coolant jackets 92*a*, 92*b* by wall 108 defining cast-in housing 58, and thus a separate sleeve is not required. However, a potential limitation of this structure is that coolant flow in to the critical valve bridge area above the fire deck 38 between the port passages 40, 42, 44, 46 and housing 58, may be restricted because of the bulkiness and close proximity of the lower end of the port passages and their close proximity to cast-in housing 58. A solution to this potential limitation is described in FIG. 9.

Figure 9:
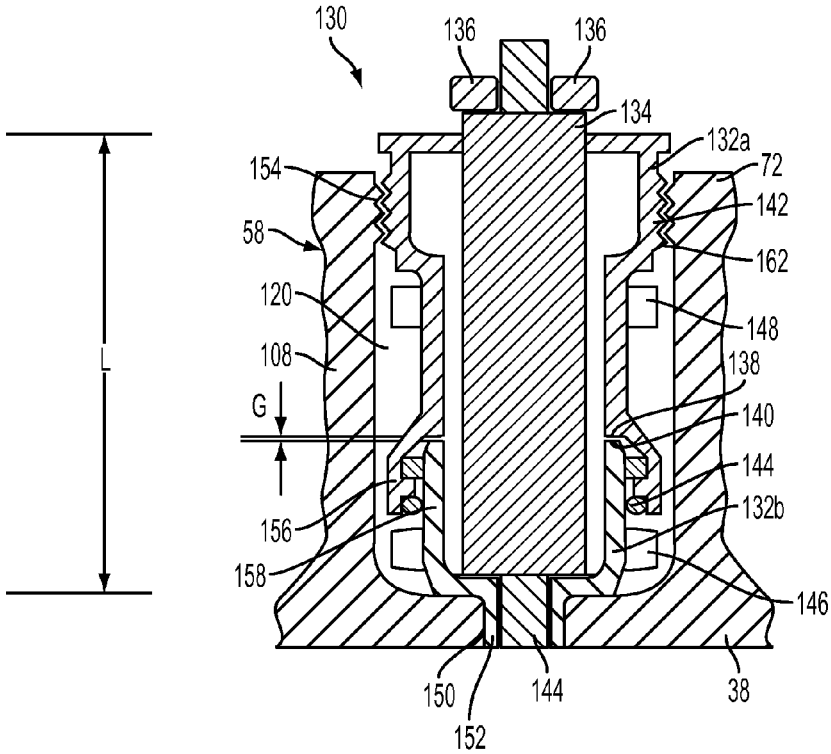
FIG. 9 is a schematic section of a two piece sleeve.

FIG. 9 shows a removable sleeve 130 which is split horizontally in to at least two mating sliding parts, upper part 132*a* and lower part 132*b*. Upper part 132*a* of the sleeve 130 is mechanically connected with the upper deck 72 as to be rigidly fixed thereto, and lower part 132*b* is mechanically connected with the fire deck 38 as to be rigidly fixed thereto.

Upper part 132*a* is mechanically connected with the upper deck 72 by means of threaded engagement between the threaded portion 142 of upper part 132*a* with mating threaded portion 154 of upper deck 72. Lower part 132*b* is mechanically connected with the fire deck 38 by means of an interference fit between nozzle opening 150 of cylinder head 10 and nozzle ring 152 of lower part 132*b*. Herein, an interference fit, also known as a press fit, is a connection between two parts which is achieved by friction after the parts are pushed together. Lower part 132*b* is also mechanically connected with the fire deck 38 by the force imposed on the injector or ignitor 134 by the injector clamp 136 which is rigidly connected to the cylinder head 10.

Upper part 132*a* and lower part 132*b* of sleeve 130 move by sliding relative to each other to change a length L of the sleeve 130. In particular, a load transfer joint is provided by upper part 132*a* and lower part 132*b*, which may be further described as a slip joint, which provides a dimensional gap G between the parts 132*a* and 132*b* as will now be discussed. Herein, a slip joint is a joint providing for dimensional change in a linear structure, which may be used to relieve stress and strain in the structure. The joint formed by upper part 132*a* and lower part 132*b* may further be described as a telescoping slip joint as the joint may extend and contract by the sliding of overlapping sections relative to each other.

As shown in FIG. 9, the sleeve lower part 132*b* slides within sleeve upper part 132*a*, with the sleeve upper part 132*a* and lower part 132*b* having overlapping cylindrical portions, 156, 158, respectively. Injector or ignitor 134, may be sealed from the coolant by a seal 144 between overlapping portions 156, 158, such as an O-ring. Within overlapping portions 156, 158, the sleeve upper and lower parts 132*a*, 132*b* having opposing portions with parallel, circular (ring) contact surfaces shown at 138, 140, which may be spaced apart such that a gap G between the contact surface 138, 140 is provided. Gap G may be adjusted by a threaded screw portion 142. More particularly, threaded screw portion 142 may be used to increase a distance between opposing contact surfaces 138, 140 of the sleeve upper part 132*a* and the sleeve lower part 132*b* and otherwise linearly move the contact surfaces 138, 140 relative to each other. As shown parallel contact surfaces 138, 140 are also horizontal, and perpendicular to the length of sleeve 130.

When sleeve 130 is installed in cylinder head 10, surfaces 138, 140 may be separated from each other by the thickness of the gap, which may have an order of magnitude of thousandths of an inch. During use, as cylinder head 10 is subjected to heat and associated thermal loads, the cylinder head 10 and sleeve 130 may dimensionally expand in a known manner. As sleeve 130 is subjected to thermal load, upper and lower parts 132*a*, 132*b* will expand such that the thickness of the gap G between contact surfaces 138, 140 may be expected to decrease. Thus, in this manner the gap G narrows to accommodate the natural expansion of parts 132*a*, 132*b* under thermal loading, which may effectively inhibit the expansion of upper and lower parts 132*a*, 132*b* from undesirably stressing and deflecting and otherwise deforming fire deck 38 towards the cylinder from the thermal expansion thereof.

Now, considering mechanical loads from the cylinder, and in particular any opposing loads from combustion, any remaining thickness of the gap G is preferably less than the maximum cylinder head deflection which may occur at the center of the cylinder head 10 (e.g. at injector/ignitor 134). Consequently, after a certain amount of fire deck 38 deformation in the form of deflection towards injector or ignitor 134, here predetermined by the remaining thickness of the gap G, the two sleeve surfaces 138, 140 butt against each other, thus providing a structural support to further mechanical loads and against further deflection of the fire deck associated with compression loads from the cylinder. Thus, the gap G can be decreased until contact surface 140 of the sleeve second part 132*b* contacts a contact surface 138 of the sleeve first part 132*a*. At this point, the joint of the sleeve 130 is in its fully contracted position as there is no gap G and can not contract further.

From the foregoing, sleeve 130 may provide a mechanism for reducing stress, deflection and other deformation of the fire deck 38 downwards (towards the cylinder) due to the thermal expansion of the sleeve 130 from above, as well as reducing stress and deflection of the fire deck 38 upwards (away from the cylinder) due to the mechanical loads of compression from below. Removable sleeve 130, therefore, may properly be considered to be a load bearing member.

Coolant may enter cavity 120 from the lower coolant jacket 92*b* via openings such as 146 and can exit to the upper coolant jacket 92*a* via openings such as 148. Coolant can be sealed from oil above the upper deck 72 via a seal provided between the upper deck 72 and sleeve upper part 132*a*, such as may be provided by a thread sealant 162, such a polytetrafluoroethylene (PTFE) tape, placed on screw thread 142 or a second o-ring installed directly below the threaded portion 142. With respect to the lower deck 38, coolant can be sealed from the cylinder below the lower deck 38 via a seal provided between the lower deck 38 and the sleeve upper part 132*a*, such as may be provided by the interference fit between the two parts.

In the foregoing manner, the area for coolant flow around the valve bridge can be increased and the sleeve 130 can be made relatively thinner in section than the walls 108 of housing 58, and so the critical valve bridge temperatures can be lowered which will in turn reduce the thermal stresses on the cylinder fire deck 38.

Figure 10:
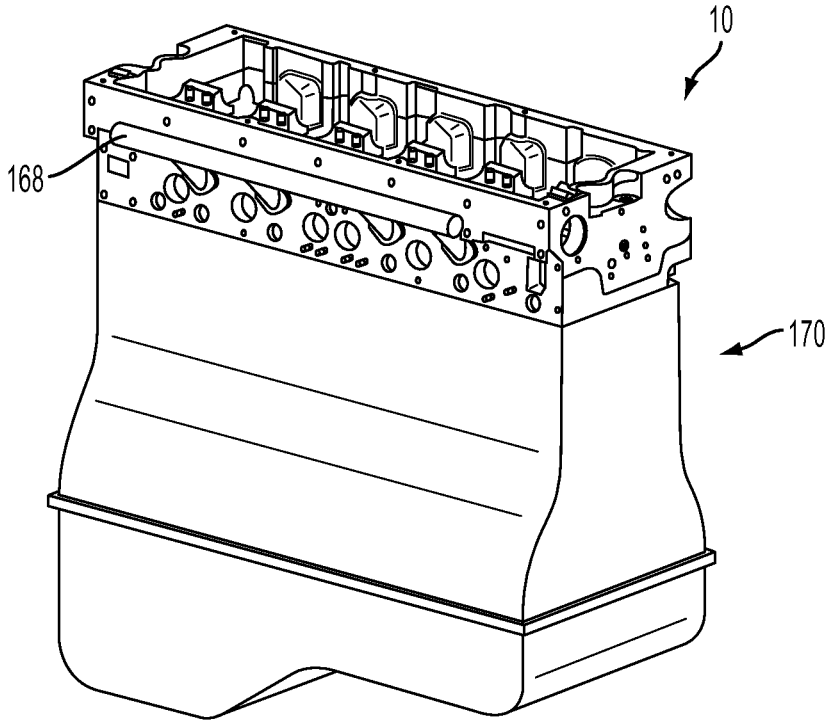
FIG. 10 is a isometric view of a cylinder head of the present invention installed on an engine.

The invention also provides a coolant flow from the lower coolant jacket 92*b* which then flows through openings 146 into cavity 120 of each housing 58, around the clearance between the two piece sleeve 132*a*, 132*b* and the walls 108. The coolant then flows through openings 148 into upper coolant jacket 92*a* and thereafter out at each cylinder, between the intermediate and upper decks, into an external coolant manifold 168 of the engine 170 as shown in FIG. 10 that collects the outflow from each cylinder and routes the flow to the cooling system.

The significance of this external coolant manifold 168 to the structural integrity of the cylinder head 10 is that it enables a cross-flow coolant path across the cylinder head 10, instead of the coolant flowing longitudinally along the cylinder head 10 which would result in higher pressure losses and reduced coolant velocities at the last cylinders to receive coolant. The cross-flow coolant path, enabled by the external coolant manifold 168, results in cooler metal sections and therefore reduced cylinder head deflections and lower stresses in the cylinder head material. The external coolant manifold 168 is usually located on the exhaust manifold side of the cylinder head 10, but may be located on the inlet manifold side of the cylinder head 10.

From the preceding descriptions, an invention is provided for a removable sleeve 130, fitted to a cylinder head 10, with the sleeve 130 being split horizontally into two mating sliding parts, the upper part 132*a* of the sleeve 130 being mechanically connected to the upper deck 72, and the lower part 132*b* being mechanically connected to the fire deck 38, with a joint between the two sleeve halves 132*a* and 132*b* to provide a gap between opposing contact surfaces 138, 140.

In one embodiment, removable sleeve 130 is used in a cylinder head 10 for at least one cylinder comprising two side walls 12, 14; two end walls 16, 18; three decks 38, 72 and 74 of preferred thickness; port walls 70, 78 of preferred thickness; a diamond shaped orientation of valve seats 20, 22, 24 and 26; a one haft upper coolant jacket 92*a*; a lower coolant jacket 92*b* and an external coolant manifold 168. In alternative embodiments, load bearing removable sleeve 130 may be replaced or used in conjunction with load bearing cylindrical housing 58 defining cavity 120 for fuel injector or ignitor 134. From this combination of features increased stiffness of the cylinder head has been shown through analysis, which may effectively inhibit undesirable stressing, deflecting and otherwise deforming of the cylinder head fire deck or other portions thereof, and a cylinder head geometry may be provided which is optimized for structural stiffness and peak operating cylinder pressure capability.

The one half coolant jacket is preferably located on the exhaust manifold side of the cylinder head. The fire deck 38 and upper decks 72 are each substantially thicker than the intermediate deck 74 and are each typically 150-300% times the thickness of the intermediate deck thickness.

The inventions disclosed herein are applicable to diesel, gasoline, liquefied propane gas (LPG), and compressed natural gas (CNG) fueled engines, which may have direct injection systems. In the case of the engine applications not utilizing compression ignition, the central injector may be substituted by an ignitor such as comprising a spark plug or micropilot injector. Also, while the invention has been described with respect to a cast cylinder head, which may be cast from metal such as iron or aluminum, it should be understood that the cylinder head may be manufactured in any suitable material or by any suitable process. More particularly, the process may provide a cylinder head having a monolithic structure. In other words, a mass of material formed as a single piece, unitary structure, which is without seams or joints associated with the connecting of two pieces or materials.

In order to improve, and preferably optimize, the structural stiffness and peak operating cylinder pressure capability of cylinder head 10, the following parameters were considered in a finite element analysis (FEA) for the design of cylinder head 10.

| Parameter | Level 1 | Level 2 |
|---|---|---|
| Upper Water Jacket | Full | Half |
| Fire Deck Thickness | 12 mm | 17 mm |
| Intermediate Deck Thickness | 5 mm | 10 mm |
| Upper Deck Thickness | 12 mm | 17 mm |
| Port Wall Thickness | 5 mm | 10 mm |
| Coolant Jacket Flow | Cross | Longitudinal |
| Port Arrangement | 45° (Diamond) | 90° (Square) |

Output data from the finite element analysis included a computer generated estimate of the deflection of the fire deck directly beneath the fuel injector in response to certain load/stress criteria placed on the various computer models. The output data from the finite element analysis was then applied to an experimental design in which it was determined that the structural stiffness and peak operating cylinder pressure capability would be improved with the use of: a half upper water jacket; the greater thicknesses of the fire deck (17 mm), intermediate deck (10 mm), upper deck (17 mm) and port walls (10 mm); a cross-flow coolant jacket and a diamond port arrangement. Structural stiffness was considered to have improved if the deflection of the fire deck could be expected to decrease in light of the parameter being reviewed.

From the foregoing, the use of a half water jacket may be considered a most influential parameter in decreasing the deflection of the fire deck (and increasing the structural stiffness and peak operating cylinder pressure capability), followed by the increased thicknesses of the fire deck, intermediate deck, upper deck and port walls. The use of a cross-flow coolant jacket, as well as a diamond port arrangement may also be found to decrease the deflection of the fire deck.

While a preferred embodiment of the present invention has been described, it should be understood that various changes, adaptations and modifications can be made therein without departing from the spirit of the invention and the scope of the appended claims. The scope of the invention should, therefore, be determined not with reference to the above description, but instead should be determined with reference to the appended claims along with their full scope of equivalents. Furthermore, it should be understood that the appended claims do not necessarily comprise the broadest scope of the invention which the Applicant is entitled to claim, or the only manner(s) in which the invention may be claimed, or that all recited features are necessary.

What is claimed is:

1. A cylinder head for an engine, the cylinder head comprising:

a valve seat arrangement for a cylinder of the engine, the valve seat arrangement comprising at least two inlet valve seats on an inlet valve seat axis at an angle in a range of 30 to 60 degrees to a major axis of the engine, and at least two exhaust valve seats on an exhaust valve seat axis at an angle in a range of 30 to 60 degrees to the major axis of the engine;

an upper deck, an intermediate deck and a fire deck;

an upper coolant jacket between the upper deck and the intermediate deck;

a lower coolant jacket between the intermediate deck and the fire deck, wherein the lower coolant jacket and the upper coolant jacket are in fluid communication such that a fluid coolant, when contained in the cylinder head, flows from the lower coolant jacket to the upper coolant jacket;

a housing forming a cavity to accommodate a fuel injector or an ignitor therein, the cavity defined by a monolithic wall of the housing connecting the fire deck with the upper deck, wherein the housing has an overall height which extends from the fire deck to the upper deck;

wherein the cavity to accommodate the fuel injector or the ignitor is in fluid communication with the upper coolant jacket and the lower coolant jacket;

wherein the monolithic wall of the housing defining the cavity to accommodate the fuel injector or the ignitor includes a plurality of openings which provide fluid communication between the lower coolant jacket and the upper coolant jacket; and wherein the monolithic wall of the housing connecting the fire deck with the upper deck and defining the cavity to accommodate the fuel injector or the ignitor further at least partially defines a passage of an intake port or an exhaust port of the cylinder head.

2. The cylinder head of claim 1 wherein:

the upper deck, the intermediate deck and the fire deck each has a thickness;

the upper deck thickness is greater than the intermediate deck thickness; and the fire deck thickness is greater than the intermediate deck thickness.

3. The cylinder head of claim 1 wherein:

the upper deck, the intermediate deck and the fire deck each has a thickness;

the upper deck thickness is in a range of 150% to 300% of the intermediate deck thickness; and the fire deck thickness is in a range of 150% to 300% of the intermediate deck thickness.

4. The cylinder head of claim 1 wherein:

the upper coolant jacket comprises a half coolant jacket.

5. The cylinder head of claim 4 wherein:

the half coolant jacket is located on an exhaust side of the cylinder head.

6. The cylinder head of claim 1 wherein:

the lower coolant jacket comprises a full coolant jacket.

7. The cylinder head of claim 1 wherein:

the lower coolant jacket comprises a cross-flow coolant jacket.

8. The cylinder head of claim 7 wherein:

the cross-flow coolant jacket provides a coolant path arranged for the coolant to flow through the cylinder head perpendicular to the major axis of the engine.

9. The cylinder head of claim 1 wherein:

the upper coolant jacket and the lower coolant jacket are in fluid communication with an external coolant manifold.

10. The cylinder head of claim 1 wherein:

the monolithic wall connecting the fire deck with the upper deck is cylindrical.

11. The cylinder head of claim 1 wherein:

the monolithic wall connecting the fire deck with the upper deck is arranged to support the fire deck against a deflection thereof by transmitting a mechanical load introduced on a flame face of the fire deck to the upper deck.

12. A cylinder head for an engine, the cylinder head comprising:

a monolithic structure forming an upper deck, an intermediate deck, a fire deck, a lower coolant jacket located between the fire deck and the intermediate deck, an upper coolant jacket located between the intermediate deck and the upper deck and a housing forming a cavity to accommodate a fuel injector or an ignitor therein, the cavity defined by a wall of the housing connecting the fire deck with the upper deck, wherein the housing has an overall height which extends from the fire deck to the upper deck;

wherein the lower coolant jacket and the upper coolant jacket are in fluid communication such that a fluid coolant, when contained in the cylinder head, flows from the lower coolant jacket to the upper coolant jacket;

wherein the cavity to accommodate the fuel injector or the ignitor is in fluid communication with the upper coolant jacket and the lower coolant jacket;

wherein the wall of the housing defining the cavity to accommodate the fuel injector or the ignitor includes a plurality of openings which provide the fluid communication between the lower coolant jacket and the upper coolant jacket; and wherein the monolithic wall of the housing connecting the fire deck with the upper deck and defining the cavity to accommodate the fuel injector or the ignitor further at least partially defines a passage of an intake port or an exhaust port of the cylinder head.

13. The cylinder head of claim 12 wherein:

the upper deck, the intermediate deck and the fire deck each has a thickness;

the upper deck thickness is greater than the intermediate deck thickness; and the fire deck thickness is greater than the intermediate deck thickness.

14. The cylinder head of claim 12 wherein:

the upper deck, the intermediate deck and the fire deck each has a thickness;

the upper deck thickness is in a range of 150% to 300% of the intermediate deck thickness; and the fire deck thickness is in a range of 150% to 300% of the intermediate deck thickness.

15. The cylinder head of claim 12 wherein:

the lower coolant jacket located between the fire deck and the intermediate deck comprises a full coolant jacket.

16. The cylinder head of claim 12 wherein:

the lower coolant jacket located between the fire deck and the intermediate deck comprises a cross-flow coolant jacket.

17. The cylinder head of claim 16 wherein:

the cross-flow coolant jacket provides a coolant path arranged for a coolant to flow through the cylinder head perpendicular to the major axis of the engine.

18. The cylinder head of claim 12 wherein:

the upper coolant jacket located between the intermediate deck and the upper deck comprises a half coolant jacket.

19. The cylinder head of claim 18 wherein:

the half coolant jacket is located on an exhaust side of the cylinder head.

20. The cylinder head of claim 12 wherein:

the lower coolant jacket and the upper coolant jacket are in fluid communication with an external coolant manifold.

21. The cylinder head of claim 12 wherein:

the wall connecting the fire deck with the upper deck is cylindrical.

22. A cylinder head of claim 12 wherein:

the wall connecting the fire deck with the upper deck is arranged to support the fire deck against a deflection thereof by transmitting a mechanical load introduced on a flame face of the fire deck to the upper deck.

23. A method of increasing the stiffness of a cylinder head for an engine, the method comprising:

providing a valve seat arrangement for a cylinder of the engine, the valve seat arrangement comprising at least two inlet valve seats on an inlet valve seat axis at an angle of 30 to 60 degrees to a major axis of the engine, and at least two exhaust valve seats on an exhaust valve seat axis at an angle of 30 to 60 degrees to the major axis of the engine;

providing an upper deck, an intermediate deck and a fire deck;

providing an upper coolant jacket between the upper deck and the intermediate deck;

providing a lower coolant jacket between the intermediate deck and the fire deck, wherein the lower coolant jacket and the upper coolant jacket are in fluid communication such that a fluid coolant, when contained in the cylinder head, flows from the lower coolant jacket to the upper coolant jacket;

providing a housing forming a cavity to accommodate a fuel injector or an ignitor therein, the cavity defined by a monolithic wall of the housing connecting the fire deck with the upper deck, wherein the housing has an overall height which extends from the fire deck to the upper deck;

wherein the cavity to accommodate the fuel injector or the ignitor is in fluid communication with the upper coolant jacket and the lower coolant jacket;

wherein the monolithic wall of the housing defining the cavity to accommodate the fuel injector or the ignitor includes a plurality of openings which provide the fluid communication between the upper coolant jacket and the lower coolant jacket; and wherein the monolithic wall of the housing connecting the fire deck with the upper deck and defining the cavity to accommodate the fuel injector or the ignitor further at least partially defines a passage of an intake port or an exhaust port of the cylinder head.

* * * * *